US006136523A

United States Patent [19]

Jezequel et al.

[11] Patent Number: 6,136,523

[45] Date of Patent: Oct. 24, 2000

[54] MICRO REACTION ZONE REACTORS

[75] Inventors: Pierre Henri Jezequel, Givry, France; Ramesh Jagannathan, Rochester, N.Y.

[73] Assignee: Eastman Kodak Company, Rochester, N.Y.

[21] Appl. No.: 08/448,053

[22] Filed: May 23, 1995

[51] Int. Cl.[7] ..... G03C 1/015

[52] U.S. Cl. ..... 430/569; 430/567; 117/938; 423/42; 423/46

[58] Field of Search ..... 430/567, 569; 117/938; 366/172.2, 181.4, 180.1, 302, 305; 423/42, 46

[56] References Cited

U.S. PATENT DOCUMENTS

| | | | |
|---|---|---|---|
| 3,415,650 | 12/1968 | Frame et al. | 430/569 |
| 4,539,290 | 9/1985 | Mumaw | 430/569 |
| 5,096,690 | 3/1992 | Saito | 423/491 |
| 5,250,403 | 10/1993 | Antoniades et al. | 430/505 |
| 5,314,798 | 5/1994 | Brust et al. | 430/567 |
| 5,317,521 | 5/1994 | Lin et al. | 364/496 |
| 5,424,180 | 6/1995 | Saitou | 430/569 |

FOREIGN PATENT DOCUMENTS

| | | | |
|---|---|---|---|
| 04139441 | 5/1992 | Japan | G03C 1/015 |

*Primary Examiner*—Mark F. Huff
*Attorney, Agent, or Firm*—Mark G. Bocchetti

[57] ABSTRACT

The present invention allows one to use a phase I reactor to make thinner silver halide grains. This is accomplished by introducing the halide salt solution and the silver salt solution as close as possible to each other above the mixer head. The reactor is essentially divided into a micro reaction zone and a bulk reaction zone, thus, emulating the effect of a phase II or two stage reactor.

3 Claims, 9 Drawing Sheets

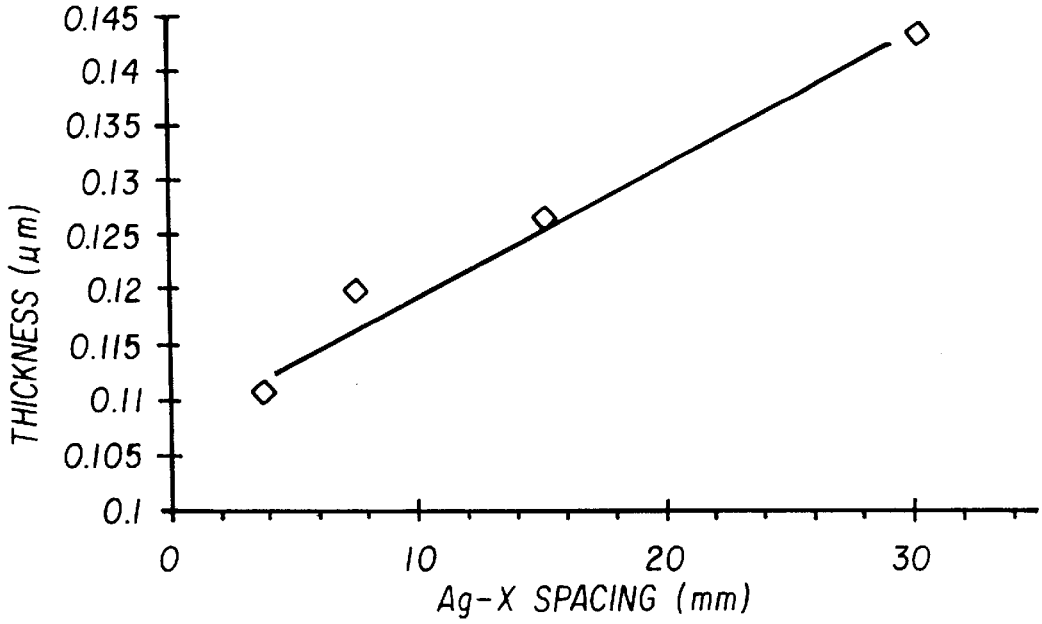
FIG. 8
FIG. 9
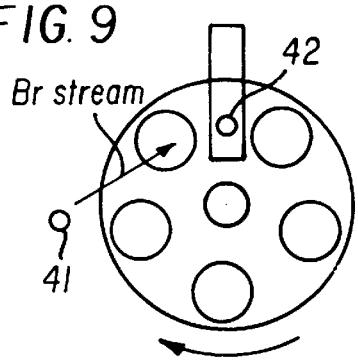
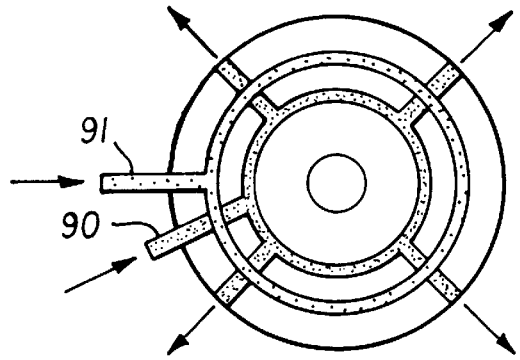
FIG. 10
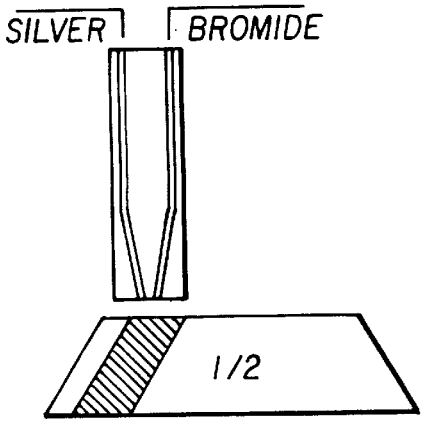
FIG. 11

MICRO REACTION ZONE REACTORS

FIELD OF THE INVENTION

The present invention relates to a method for making silver halide emulsions. More particularly, the present invention allows one to make extremely thin silver halide grains.

BACKGROUND OF THE INVENTION

Dual zone reactors as described in U.S. Pat. No. 5,250,403 are used in the making of silver halide emulsions. The silver halide photographic emulsions are prepared by forming in a first reaction vessel a population of silver bromide grain nuclei and transporting the nuclei to a second growth vessel. Such a device is able to produce tabular silver halide grains with improved morphological properties. However, dual zone reactors have a higher cost associated with them than single zone reactors. Thus, it is desirable to be able to produce thin silver halide grains in a conventional double-jet or single zone reactor in order to lower the cost of producing the silver halide grains.

The present invention allows one to produce thin silver halide grains or tabular grains in one reaction vessel.

SUMMARY OF THE INVENTION

The present invention is a method of producing silver halide grains. The method includes providing a mixer having an inlet surface and an outlet surface and at least one flow channel extending from the inlet surface to the outlet surface. The mixer is rotated. A silver nitrate solution is introduced at the inlet surface of the mixer and (simultaneously therewith a halide salt solution is introduced at the inlet surface of the mixer within 30 mm of the introduction of the silver nitrate solution. The silver halide grains produced from this process are extremely thin and have a very high aspect ratio.

BRIEF DESCRIPTION OF THE DRAWING

FIG. 5(*b*) is a graph of the grain volume versus relative count of the silver halide grains.

FIG. 6(*b*) shows a graph of grain volume versus relative count of the silver halide grains.

FIG. 7(*b*) shows a graph of grain volume versus relative count of the silver halide grains.

FIG. 8 shows the effect of spacing of the silver and halide introduction points on the size of the silver halide grains produced.

FIG. 9 shows an alternate embodiment of the mixer used in the present invention.

FIG. 10 shows a top view and a sectional view of a spreader used with the present invention.

FIG. 11 shows a schematic of an alternate embodiment of the present invention.

For a better understanding of the present invention together with other objects, advantages and capabilities thereof, reference is made to the following description and appended claims in connection with the above described drawing.

DETAILED DESCRIPTION OF THE PREFERRED EMBODIMENTS

The present invention is directed to preparing significantly thinner tabular silver halide grains than those prepared with regular phase I reactors. Phase I reactors refer to reactors; which produce the silver halide grains in one reaction vessel. Dual zone precipitators are similar to phase I reactors except than, instead of adding ionic solutions with pumping devices, fine nuclei continuously prepared in a separate nucleator are introduced into a growth reactor. Therefore, the output from the nucleator in the dual zone reactor is substantially free of ionic silver and is not highly supersaturated. In addition, the pBr of the output solution can be adjusted before being introduced into the growth reactor. It is believed that these two phenomena are responsible for the thickness decrease observed in silver halide grains using dual zone reactors. The purpose of the present invention is to mimic the behavior of a dual zone reactor in a regular phase I system.

In a regular phase I reactor, the fresh silver reactant is continuously and instantaneously diluted with the bulk reactor solution when it arrives into the reactor. Examples of mixers used in phase I reactors are described in U.S. Pat. Nos. 3,415,650 and 5,096,690. In addition, International Application No. PCT/US94/07378 describes a mixer that can be used in a phase I reactor. This mixer head is referred to as a PEPA mixer. The experiments described below all used the PEPA mixer, although improved silver halide grains are possible using any of the prior art mixers described.

Figure 1:
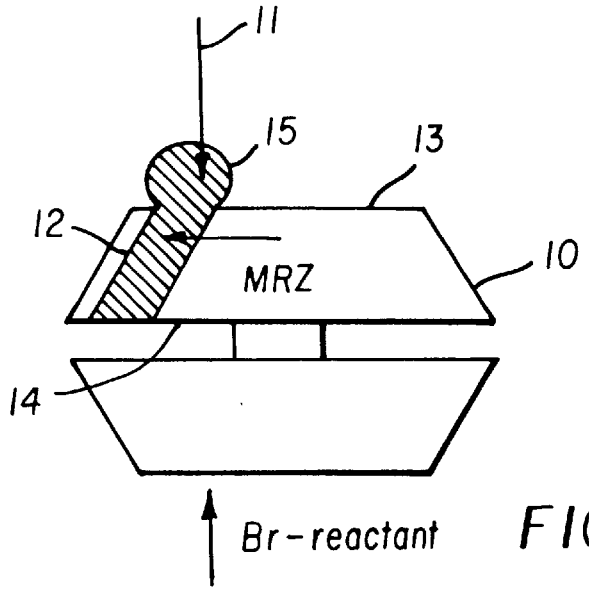
FIG. 1 (PRIOR ART)
FIG. 1 shows a schematic of a mixer in a phase I reactor.

Shown in FIG. 1 is a mixer inside a conventional double-jet reactor. The mixer 10 includes a series of conduits 12 (only one is shown in FIG. 1) which extend from a first surface 13 to a second surface 14. The zone 15 over the conduit 12, where concentrated silver provided through conduit 11 enters the precipitator containing an excess bromide is referred to as a micro reaction zone or MRZ. This zone is shown as 15 and is shaded.

Since dilution of the fresh silver reactant introduced at 15 is critical, a dimensionless dilution ratio is defined as:

$$\text{Dilution Ratio} = \frac{\text{(Bulk) Molar Bromide Flow Rate at } MRZ}{\text{(Reactant) Molar Silver Flow Rate}} \quad (1)$$

or, expressed as a function of the process parameters:

$$\text{Dilution Ratio} = \frac{k_q \cdot \text{rpm} \cdot CBr^{-}_{Bulk} \cdot \text{\# Spreader holes}}{CA^{+}_{Reactant} \cdot QAg \cdot \text{\# holes}} \quad (2)$$

Where $k_q$ is a constant, characteristic of the pumping flow rate of the mixer, $CBr^{31}{}_{Bulk}$ is the halide concentration of the reactor, QAg is the flow rate of the silver reactant and $CAg^{+}$ is the concentration of the silver reactant. The # Spreader holes is the number of silver introduction points in the reactor. The # holes is the number of conduits that extend from the first surface of the mixer to the second surface.

This ratio expresses how fresh silver reactant is mixed with the bulk halide pumped by the mixer through the phase I reactor as shown in FIG. 1. It can also directly be related to the local average pBr of the MRZ. It is clear that, due to the dilution and the very fast rate of the precipitation reaction, the average pBr of the MRZ is very different from the average bulk pBr. The formula of the dilution ratio in equation 2 shows that the differences are magnified for low mixer pumping rates, high silver nitrate concentrations and high silver reactant flow rates. In addition, taking into account the boundary conditions, it is also clear that very high local pBr gradients exist in the MRZ, which implies the presence of large local supersaturation gradients.

Figure 2:
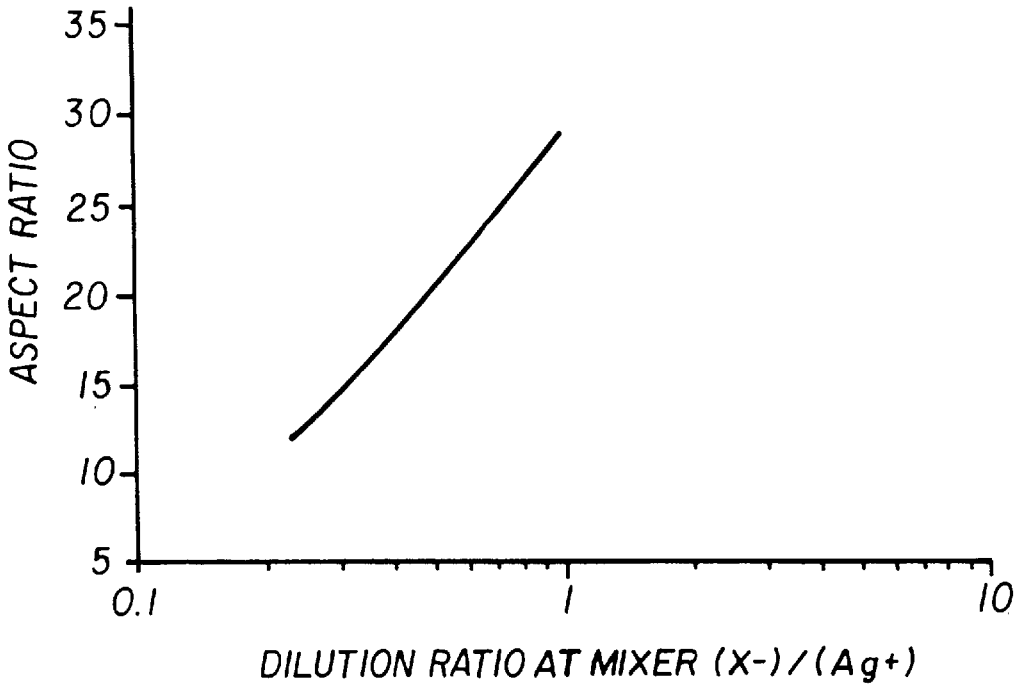
FIG. 2 is a graph showing aspect ratio versus dilution ratio in a phase I reactor.

Although other theoretical approaches led to similar conclusions, it has also been experimentally demonstrated that there is a direct relationship between the dilution ratio and aspect ratio of AgBr tabular-grain emulsions (FIG. 2). It clearly appears from FIG. 2 that an increase in the dilution ratio also induces a significant increase in the aspect ratio of the silver halide grains of the emulsion.

Consequently, the principal of the present invention is a process allowing an increase in the dilution ratio at the reaction zone, without changing the bulk characteristics of the reactor. The grains produced are thinner than those from regular phase I reactors. Owing to the sparingly soluble characteristics of silver halide, the mean bulk $Br^-$ concentration at equilibrium is generally low. From equation 2, it is easy to determine that an increase of the bromide concentration is one of the simplest parameters to adjust if one wants to increase the dilution ratio. Since the bulk pBr cannot be modified without severe changes to the emulsion characteristics, only local changes in the MRZ pBr are possible without effecting the bulk pBr. Therefore, the preferred technique is to add salt as close to the MRZ as possible so that the dilution ratio can be rewritten as equation 3.

$$\text{Dilution Rate} = \frac{k_q \cdot \text{rpm} \cdot (CBr^-_{Bulk} + CBr^-_{MRZ}) \cdot \#\text{ Spreader holes}}{CAg^+_{Reactant} \cdot QAg \cdot \#\text{ holes}} \quad (3)$$

Figure 3:
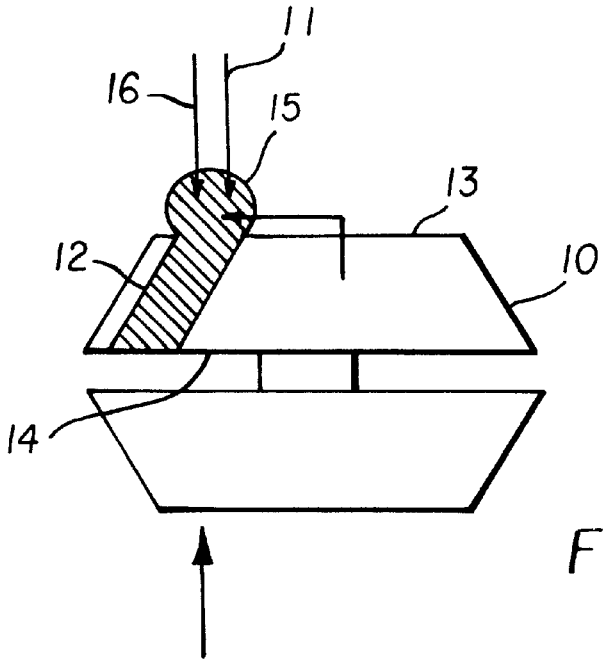
FIG. 3 shows a schematic of a mixer/distributor assembly used to carry out the invention of the present invention.

FIG. 3 shows a schematic arrangement of the apparatus used to carry out the method of the present invention. As shown in FIG. 3 the bromide is added at the MRZ 15 through an extra delivery port 16. The bromide is added as close as possible to the silver introduction port 11 above surface 13 of the mixer. By introducing bromide reactant right above the surface 13 of the mixer, a bromide screen is formed which lowers the pBr and drops the supersaturation of the silver by converting the ionic silver to silver halide. Thus, the conventional double-jet reactor is made to mimic the nucleator output in a dual zone reactor.

The following example describes the use of an additional bromide line close to the silver line on top of the PEPA mixer. Several types of experimental devices, some of which have been tested and some of which are logical extensions of the method described in Example 1, are described below. These include a single addition point without premixing, multiple addition points without premixing and a single addition point with premixing.

EXAMPLE 1

Single Addition Point Without Premixing

Figure 4A:
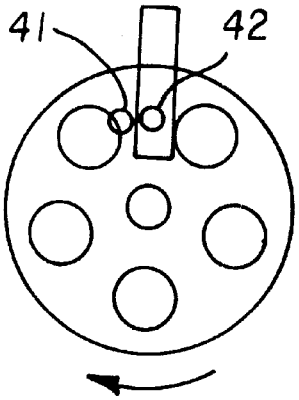
FIGS. 4(*a*) and (*b*) show a top view of the mixer and the positioning of the silver and halide solution inlets, FIG. 4(*a*) shows salt addition "before" silver addition and FIG. 4(*b*) shows salt addition "after" silver addition.
Figure 4B:
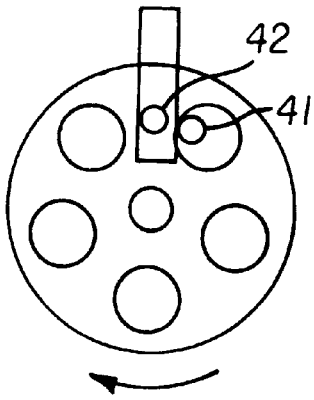

Shown in FIG. 4 is a top view of the mixing head and the introduction points (41, 42) for the halide (41) and the silver (42) solutions used in the present invention. FIG. 4(*a*) shows the halide introduction before the silver introduction looking at the rotation of the mixer and FIG. 4(*b*) shows the halide introduction after the silver introduction. Plastic tubes of the same inner diameter were used to deliver the silver in the halide. The thin walls of the tubing allowed placement of the Two tubes above the mixer head so that the center-to-center distance was 3 mm. It is preferable that these tubes be as close to each other as possible and no more than 30 mm from center-to-center. It is also preferable that the tubes are placed substantially parallel. The distance between the mixer shaft and the end of each delivery tube is constant. That is, the same radial gap from the inlet surface exists for the silver introduction tube and the halide introduction tube. The formulas tested are pure AgBr tabular emulsions used in medical x-ray films. The kettle was initially filled with gelatin at 0.4% and anti-foamant at 76.7° C. The nucleation was done with diluted silver at a low vAg (vAg≈−16 mV) and reactant concentrations of $CAgNO_3$=1 mole/liter and CNaBr=1 mole/liter. This was followed by a gel dump to increase the gelatin content to 1.2%. The growth is split into two parts. Growth in the first phase is achieved at −3 mv at 30 ml per minute. A vAg shift to 50 mv at 30 ml per minute allows the reactor to reach the conditions for growth in the second phase. This step was initially carried out with flow rates ramping linearly from 30 to 60 mm per minute and is completed with a 30 minute segment at 60 ml per minute. Concentrated reactants ($C_{AgNO3}$=2.5 mol/liter, $C_{NaBr}$=2.6 mol/liter) were used during the growth segment. For the reference emulsion, the bromide solution was added on the opposite side of the mixer, aligned with the introduction point of the silver solution.

Figure 5A:
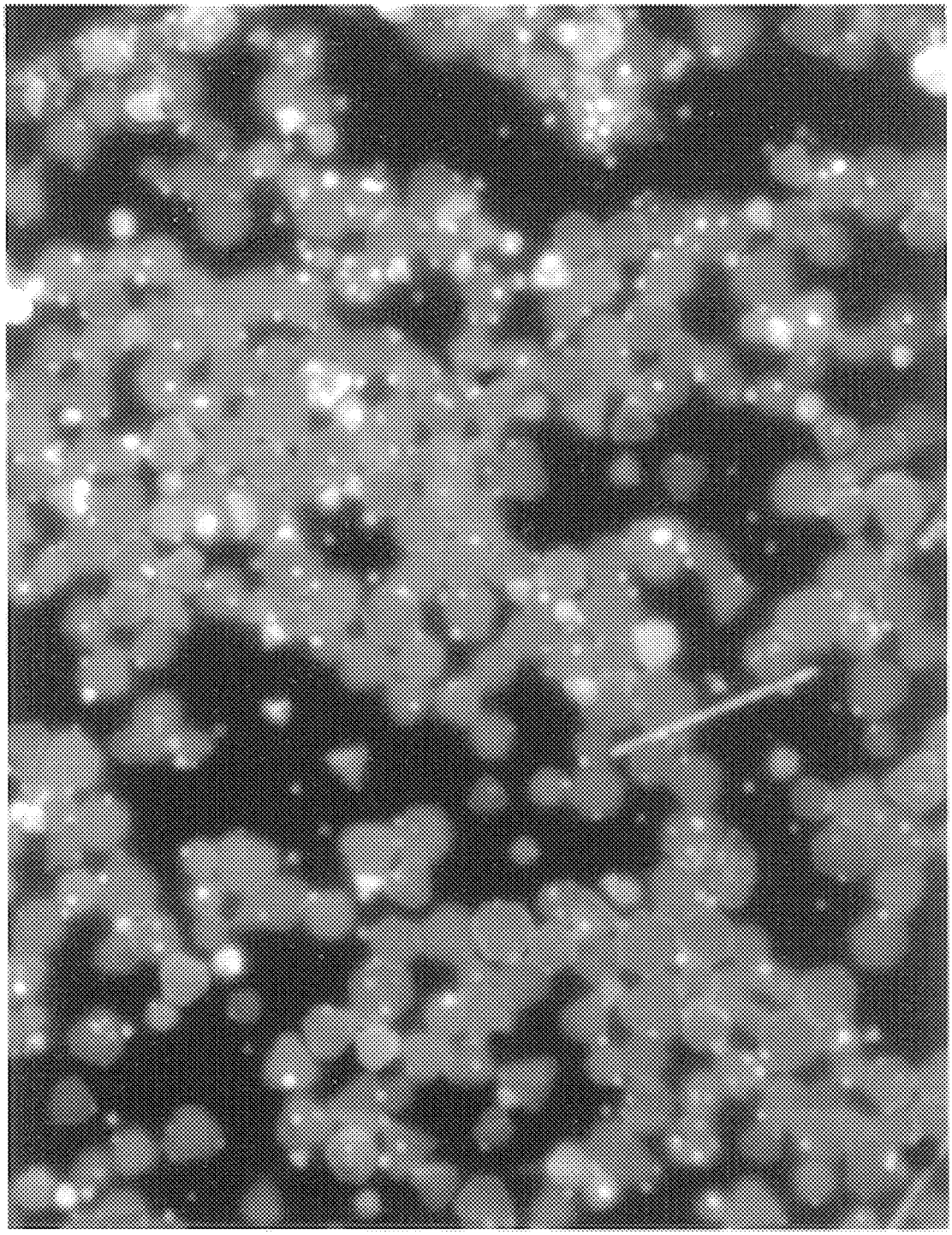
FIG. 5A (PRIOR ART)
FIG. 5(*a*) shows an optical micrograph of an emulsion made with a typical phase I reactor.
Figure 5B:
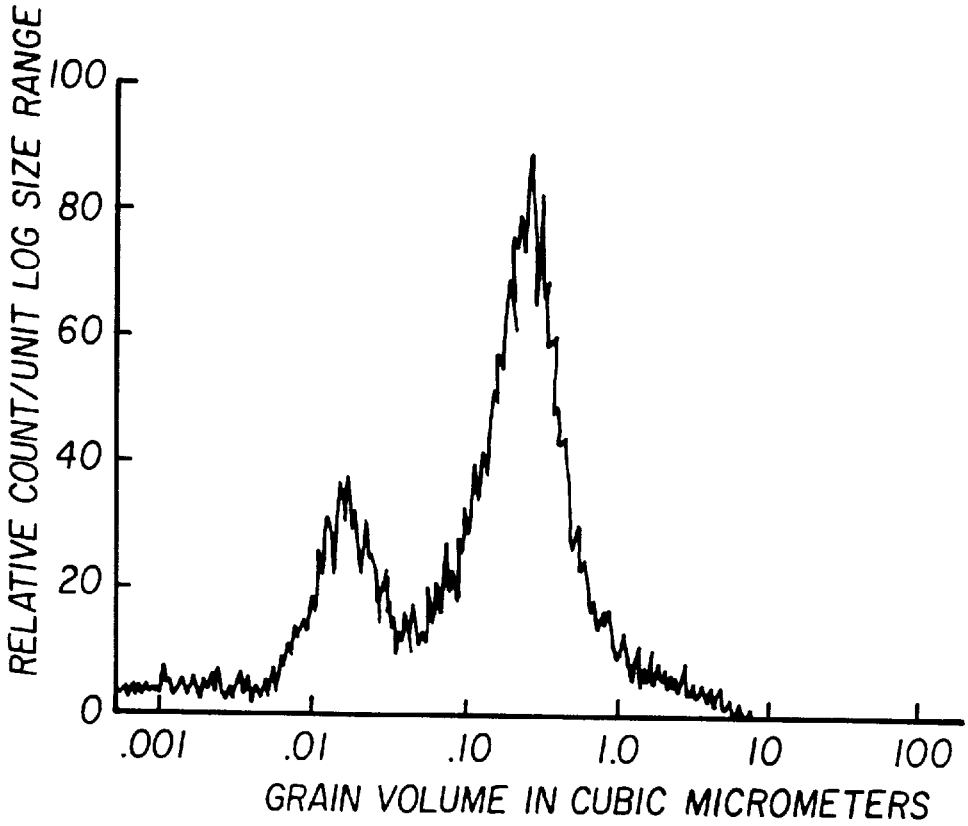
FIG. 5(b) (PRIOR ART)
Figure 6A:
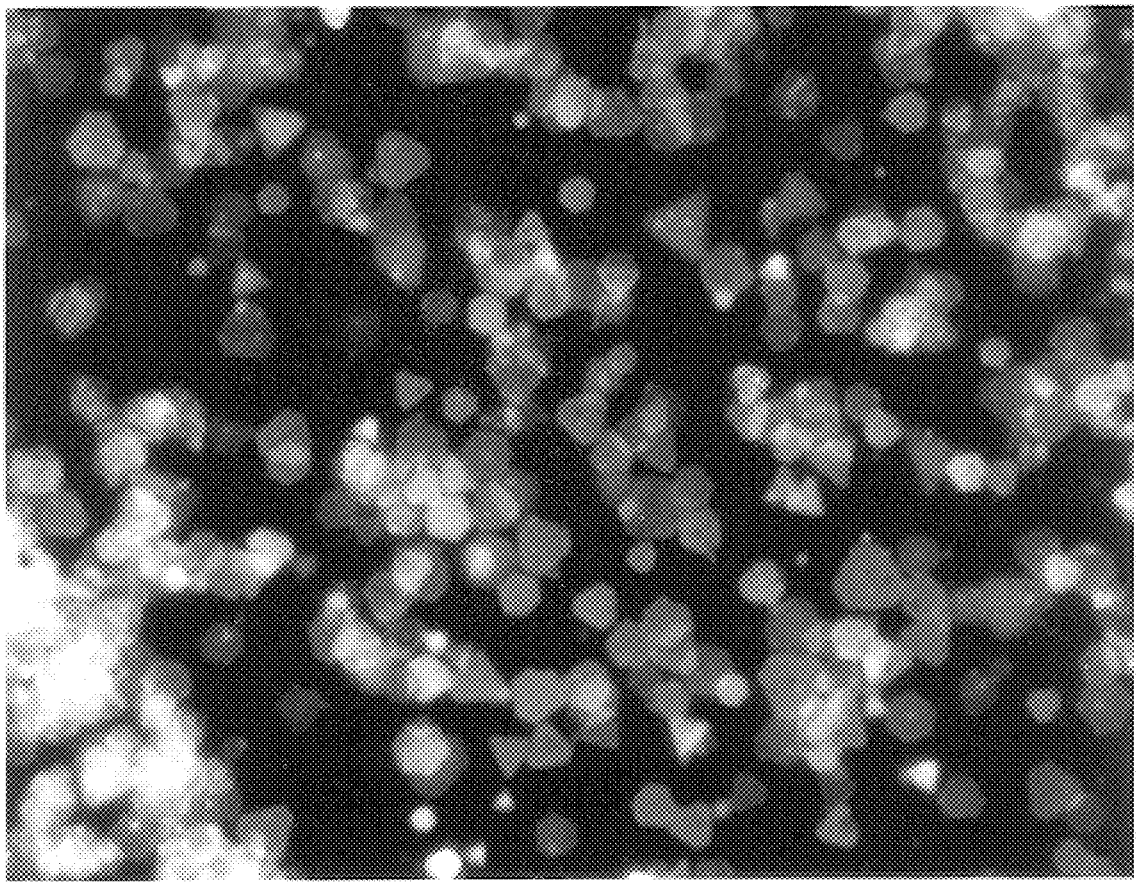
FIG. 6(*a*) shows an optical micrograph of an emulsion made using the present invention with the halide solution added before the silver salt solution.
Figure 6:
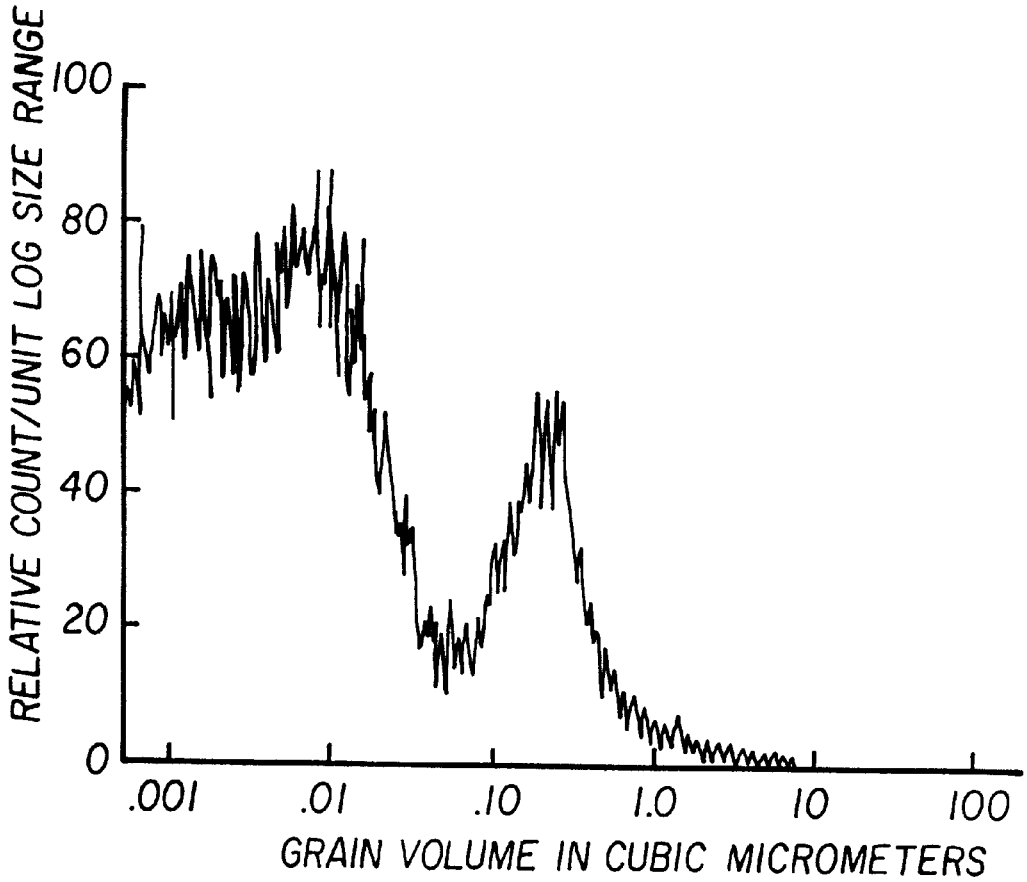
Figure 7A:
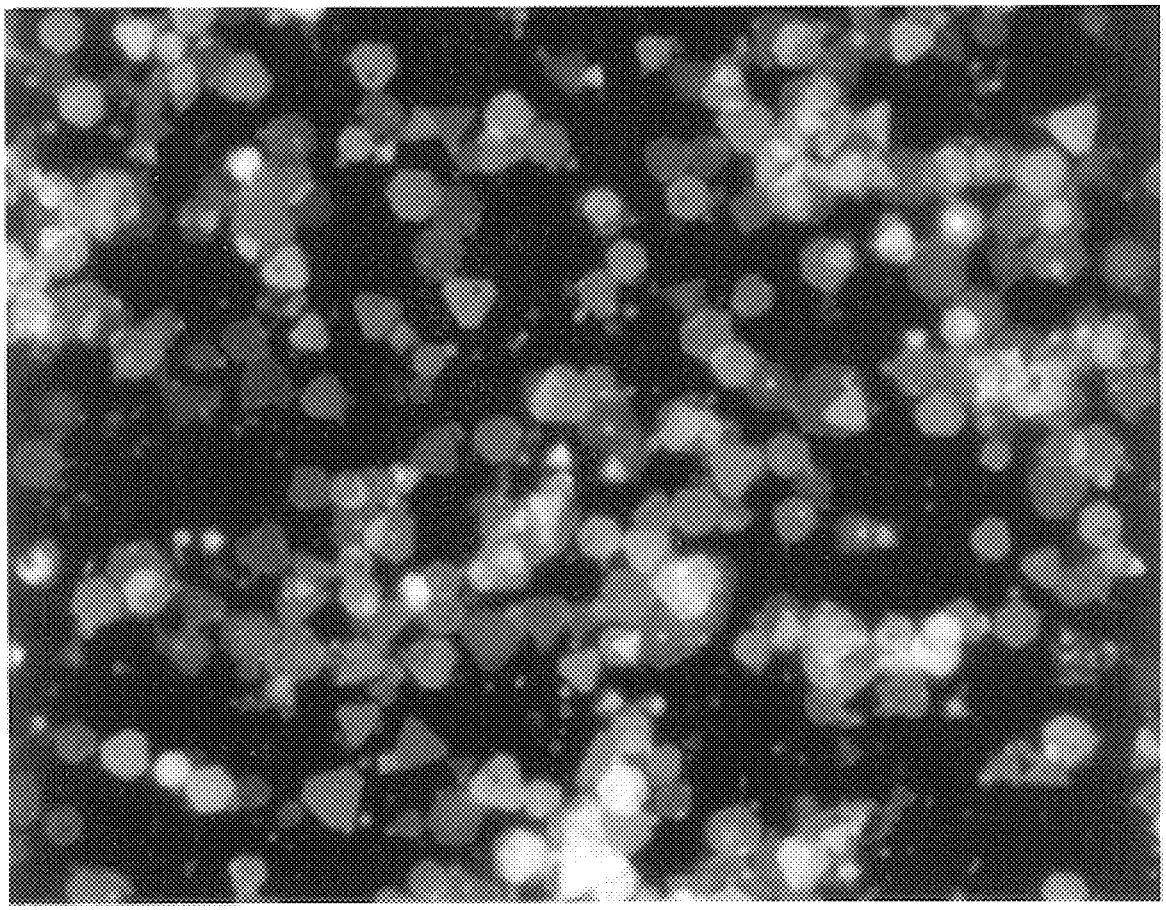
FIG. 7(*a*) shows an optical micrograph of an emulsion made using the present invention with the halide salt solution added after the silver salt solution.
Figure 7B:
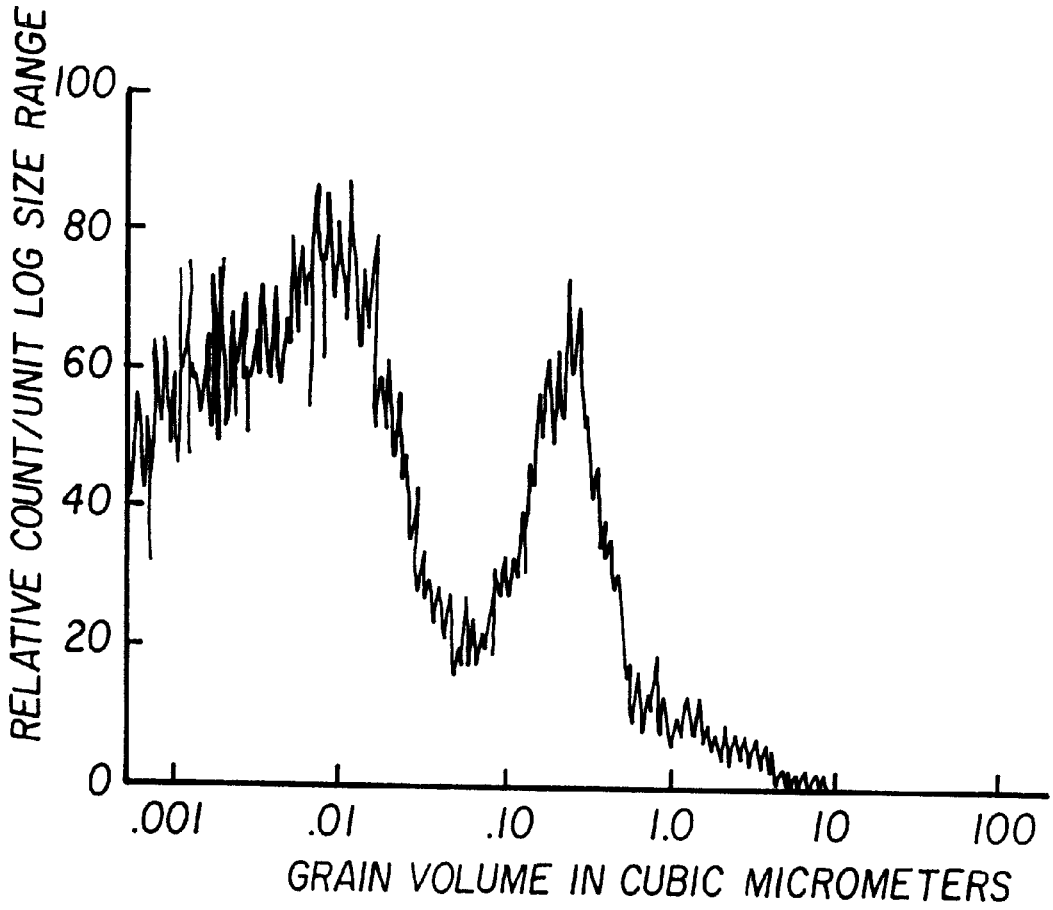

FIG. 5 shows an optical micrograph of the reference emulsion which was prepared in a conventional double-jet reactor method. FIG. 6 shows an optical micrograph of the same emulsion using the device shown in FIG. 4(*a*). FIG. 7 is an optical micrograph using the device shown in FIG. 4(*b*).

In the cases shown in FIGS. 6 and 7, 100% of the halide is added on the top, respectively, before or after the silver. In comparison to the reference emulsion shown in FIG. 5 where none of the halide is added at the silver introduction point.

Results of the emulsions made show that larger grains are made using the process of the present invention. In addition, she grains of the emulsions made using the present invention are thinner.

FIG. 8 is the result showing the thickness versus the spacing between the silver and the salt introduction points.

Shown in FIG. 9 is a top view of a mixing head and introduction points for the halide 41 and silver 42 solutions. In this embodiment, the halide stream is placed away from the silver introduction stream approximately 30 mm. Because some renucleation can occur with the device shown in FIGS. 4(*a*) and (*b*), this problem is overcome by moving the bromide stream away from the silver addition point. As seen in FIG. 9, the directional output of the bromide solution is toward the silver point, over the mixer. The silver and salt introduction tubes are no longer parallel as shown in FIGS. 4(*a*) and (*b*). To compensate for the increased distance between the silver and bromide addition points, and to maintain the same pBr in the MRZ, the bromide solutions which are much more concentrated than the silver nitrate solutions are necessary. Moreover, this embodiment allows one to use two variables, namely, the distance between the salt and the silver introduction tubes and the ratio of silver to salt concentration to manipulate the thinness of the emulsion grains.

In an alternate embodiment of the device as shown in Example 1 and in Example 2 silver and salt can both be added to the main reactant through several introduction points. Several silver lines are used, the number of MRZ's in the kettle will be increased accordingly. This is shown in Equation 2 wherein the dilution ratio can be increased by adding several silver introduction points. One device that is used to provide several silver introduction points is described in U.S. Pat. No. 5,241,992. FIG. 10 shows a 4 hole spreader for a silver halide precipitation kettle. The spreader can be used either on the top or the bottom of the mixer, or both. The spreader includes a silver solution supply 90 with four introduction points and a halide supply 91 with four introduction points. A regular single bromide addition point as well as a bromide spreader can also be used instead of the second spreader. With this device, very thin grains have been generated, but determination of their actual thickness with usual techniques is challenging. Coupled transmission electron microscopy and x-ray fluorescent techniques have determined the existence of small fractions of T-grain populations with a thickness below 25 nm, which is much lower than with either regular phase I or phase II reactors. It has even been demonstrated that the existence of some grains having thicknesses as low as 8 to 17 nm.

Single Addition Points With Premixing

With the idea of mimicking the dual zone reactor, premixing of the silver and the salt solutions is achieved right before introduction of the reactants to the main reactor so that nuclei are generated. This is shown in FIG. 11 where the premixing is achieved using silver and halide introduction tips that are positioned above the mixer head at an angle so that the two solutions are directed towards each other before entering the mainstream solution.

The main advantage of the micro reaction zone reactors described is to precipitate thinner grains than those usually precipitated with conventional reactors. Consequently, the advantages of the present invention are those that are produced by thinner silver halide grains. These advantages include silver reduction in the photographic emulsion, increased radiation sensitivity and optical properties.

While there has been shown and described what are present considered the preferred embodiments of the invention, it will be obvious to those skilled in the art that various alterations and modifications may be made therein without departing from the scope of the invention.

What is claimed is:

1. A method of producing thin silver halide grains comprising:

providing a mixer having an inlet surface and an outlet surface and at least one flow channel extending from the inlet surface to the outlet surface;

rotating the mixer;

introducing a silver nitrate solution at the inlet surface of the mixer; and introducing a halide salt solution at the inlet surface of the mixer within 30 mm of the introduction of the silver nitrate solution wherein silver halide grains having a maximum thickness of 0.145 $\mu$m are produced.

2. A method of producing thin silver halide grains comprising:

providing a mixer having an inlet surface and an outlet surface and a plurality of flow channels extending from the inlet surface to the outlet surface;

rotating the mixer;

introducing a silver nitrite multiple solutions at multiple locations at the inlet surface of the mixer;

introducing a halide salt solution at multiple locations at the inlet surface of the mixer spaced within 30 mm of the multiple locations of the silver nitrate solution introduction wherein silver halide grains having a maximum thickness of 0.145 $\mu$m are produced.

3. A method of producing thin silver halide grains comprising:

providing a mixer having an inlet surface and an outlet surface and at least one flow channel extending from the inlet surface to the outlet surface;

rotating the mixer;

introducing a silver nitrate solution at the inlet surface of the mixer;

introducing a halide salt solution at the inlet surface of the mixer wherein the silver nitrate solution and halide salt solution are mixed prior to introduction wherein said silver halide grains have a maximum thickness of 0.145 $\mu$m.

* * * * *